US005636760A

United States Patent [19]

Yamamoto et al.

[11] Patent Number: 5,636,760

[45] Date of Patent: Jun. 10, 1997

[54] CONTAINER FOR FLUID

[75] Inventors: Yasuo Yamamoto, Tsuchiura; Toru Takemura, Tsukuba, both of Japan

[73] Assignee: Riso Kagaku Corporation, Tokyo, Japan

[21] Appl. No.: 251,853

[22] Filed: May 31, 1994

[30] Foreign Application Priority Data

Jun. 8, 1993 [JP] Japan ..... 5-137700
Jun. 8, 1993 [JP] Japan ..... 5-137701

[51] Int. Cl.[6] ..... B65D 25/16

[52] U.S. Cl. ..... 220/453; 220/723; 222/389

[58] Field of Search ..... 220/723, 453, 220/562, 468; 222/389, 183

[56] References Cited

U.S. PATENT DOCUMENTS

| | | | |
|---|---|---|---|
| 2,564,163 | 8/1951 | Leperre . | |
| 3,082,927 | 3/1963 | Winstead . | |
| 3,949,720 | 4/1976 | Zipprich et al. | 220/723 |
| 4,185,758 | 1/1980 | Giggard | 220/723 |
| 4,308,973 | 1/1982 | Irland | 220/723 |
| 4,364,416 | 12/1982 | Jacobellis et al. | 220/723 |
| 4,763,805 | 8/1988 | Strock | 220/723 |
| 5,344,038 | 9/1994 | Freeman et al. | 220/453 |

FOREIGN PATENT DOCUMENTS

| | | |
|---|---|---|
| 0 330 785 | 9/1989 | European Pat. Off. . |
| 0 453 172 A3 | 10/1991 | European Pat. Off. . |
| 2081244 | 12/1971 | France . |
| WO91/10604 | 7/1991 | WIPO . |

*Primary Examiner*—Joseph M. Moy
*Attorney, Agent, or Firm*—Kanesaka & Takeuchi

[57] ABSTRACT

A container for a fluid is formed of a soft, inner container for containing the fluid and a rigid, outer container, the inner container being disposed within the outer container, both containers having a discharge port common to each other. Approximately half from the discharge port side of the inner container bonded to the outer container.

7 Claims, 11 Drawing Sheets

CONTAINER FOR FLUID

BACKGROUND OF THE INVENTION

The present invention relates to a container for a fluid and more particularly to a container effective for a liquid having a high viscosity.

As a container for a liquid there has been known, as shown in FIG. 13, a bag-in-box type container (hereinafter referred to as "BIB container") comprising a rigid, outer container 50 formed of a hard paperboard and a soft, inner container (inner bag) 51 constituted by a flexible bag and disposed within the outer container.

In the BIB container, the outer container 50 protects the container against external impact, etc. while retaining a predetermined box shape, and by contraction of the inner container 51, a liquid 52 as the contents of the inner container 51 can be withdrawn from a discharge port 53.

In the case where a liquid having a high viscosity, e.g. ink, is contained in the BIB container, it can be withdrawn from the inner container 51 by providing a suction nozzle in the portion of the discharge port 53 and by suction of the liquid using a pump or the like.

In the conventional BIB container, however, the inner bag 51 is deformed irregularly during withdrawal of the liquid 52 from the interior of the container, resulting in that, as shown in FIG. 13, portions of the inner bag 51 adhere closely to each other to create an independent compartment 54 within the inner bag and that the liquid 52 in the compartment 54 stays therein without being withdrawn, and the amount thereof is not constant.

In the case of liquid suction using a pump, there arises unevenness between the amount of liquid discharged in the initial stage and that in the latter-half stage, and thus it has so far been impossible to withdraw the liquid from the inner bag in a constant volume from beginning to end.

SUMMARY OF THE INVENTION

The present invention has been accomplished in view of the above-mentioned problems and it is the object of the invention to provide a container for a liquid capable of withdrawing the liquid uniformly from beginning to end without staying in the container and while preventing close adherence of portions of an inner container.

In order to achieve the above-mentioned object, in a first aspect of the present invention there is provided a container for a liquid comprising a soft, inner container for containing the liquid and a rigid, outer container, the inner container being disposed within the outer container, with a discharge port common to both, wherein the face of the inner container where the discharge port is present and approximately half from the discharge port side of each of the faces of the inner container adjacent to the face with the discharge port formed therein are bonded to the outer container.

In a second aspect of the present invention, there is provided a container for a liquid comprising a soft, inner container for containing the liquid and a rigid, outer container, the inner container being disposed within the outer container, with a discharge port common to both, wherein the face of the inner container where the discharge port is present and any one of faces adjacent thereto are bonded to the outer container.

In each of the above liquid containers, an edge portion defined by unbonded faces of the inner container may be set larger in the radius of curvature than that defined by the bonded faces.

In a fourth aspect of the present invention, there is provided a container for a liquid comprising a rigid, outer container, a soft, inner container disposed within the outer container and a discharge port common to both inner and outer containers, wherein a part of the face of the inner container which surrounds the discharge port is bonded to the outer container.

In the liquid container of the first aspect of the present invention, the face where the discharge port is present and about half from the discharge port side of a face adjacent to the face are bonded to the outer container, so that as the liquid is withdrawn from the discharge port, a deformed portion on the face side opposed to the face with the discharge port gets into an undeformed portion on the discharge side, but until when the liquid is withdrawn almost completely, close adherence of the portions of the inner container is prevented and a flowing path of the contents can be ensured sufficiently without blocking of the discharge port, whereby the contents can be withdrawn uniformly and with little residue from beginning to end.

In the liquid container of the second aspect of the present invention, the face where the discharge port is present and any one face adjacent thereto are bonded to the outer container, and while a diagonal portion of both-side faces adjacent to both such bonded faces is held by the outer container, a deformed portion on the face side opposed to the face with the discharge port gets into an undeformed portion on the discharge port side, but until when the liquid is withdrawn almost completely, close adherence of portions of the inner container is prevented and a flowing path of the contents can be ensured sufficiently without blocking of the discharge port, whereby the contents can be withdrawn uniformly and with little residue from beginning to end. In this case, the number of bonded faces and the bonding area of the inner container for the outer container can be kept to a minimum.

Further, a corner of the side where an unbonded portion of the inner container is present or a corner where unbonded portions are in contact with each other has a radius of curvature, and when the inner container is deformed by flowing of the contents thereof, the deformed portion gets into the undeformed portion, but since the edge portion defined by the non-contacted faces is larger in the radius of curvature than the edge portion defined by the contacted faces, a gap is formed between the deformed portion and the undeformed portion, whereby it is made possible to ensure a sufficient flowing path of the contents up to the discharge port.

In a fifth aspect of the present invention, there is provided a container for a liquid wherein a plurality of inward protuberances are formed on the face having a discharge port around the discharge port or on a face which opposes to the discharge port at the time of deformation and surrounding the discharge port.

In a sixth aspect of the present invention, there is provided a container for a liquid wherein a plurality of inward protuberances are formed on substantially the whole of an undeformed portion including a face where a discharge port is present and corresponding to about one half of the entire portion or on substantially the whole of a deformed portion other than the undeformed portion.

According to a container for a liquid defined in seventh and eighth aspect of the present invention, the amount of projection or spacing of the protuberances in the above container is larger or smaller as the distance from the discharge port becomes shorter.

In a ninth aspect of the present invention, there is provided a container for a liquid in combination with the container defined in the fifth to eighth aspects, wherein the container has a double structure of a rigid, outer container and a soft, inner container disposed within the outer container, the undeformed portion having a fixed structure at the inner container.

According to the liquid container defined in the fifth aspect of the present invention, a plurality of protuberances are formed on the face with the discharge port or on a face which opposes to the face upon deformation, so even when the deformed portion gets inside the undeformed portion in the course of withdrawal of the contents from the discharge port, close adherence of the inner wall surfaces at the potion of the discharge port is prevented by the protuberances and gaps are formed in the container. Moreover, since a sufficient flowing path of the contents is ensured around the discharge port, the contents can be withdrawn in a constant volume and with little residue from beginning to end.

According to the liquid container defined in the sixth aspect of the present invention, since a plurality of inward protuberances are formed on substantially the whole of an undeformed portion including a face where a discharge port is present and corresponding to about one half of the entirety or on substantially the whole of a deformed portion other than the undeformed portion, even if the deformed portion is deformed along the inside of the undeformed portion, close adherence of the inner wall surfaces at the portion of the discharge port is prevented by the protuberances, and gaps are formed in the container as in the container of the fifth aspect of the present invention, so that a sufficient flowing path of the contents is ensured not only around the discharge port but also in the portion up to the same port.

According to the liquid container of the seventh aspect of the present invention, since the amount of projection or the spacing of the protuberances becomes smaller as the distance from the discharge port becomes shorter, the amount of the contents withdrawn near the discharge port is limited to a certain extent to keep the degree of decrease uniform with respect to the contents of the container.

Further, according to the liquid container of the eighth aspect of the present invention, since the amount of projection or the spacing of the protuberances is larger as the distance from the discharge port becomes shorter, it is possible to withdraw a larger amount of contents from the discharge port while ensuring a sufficient amount of contents around the same port.

BRIEF DESCRIPTION OF THE DRAWINGS

FIG. 1(*b*) is a perspective view of the container with the contents thereof removed completely;

FIG. 1(*c*) is a sectional view of the container, showing states before and after removal of the contents;

FIG. 2(*b*) is a perspective view of the container with the contents thereof removed completely;

FIG. 2(*c*) is a sectional view of the container, showing states before and after removal of the contents;

FIG. 3(*b*) is a sectional view of the container, showing states before and after removal of the contents;

FIG. 4(*b*) is a perspective view of the container with the contents thereof removed completely;

FIG. 4(*c*) is a sectional view of the container, showing states before and after removal of the contents;

FIG. 6(*b*) is a sectional view of the container with the contents thereof removed completely;

FIG. 7(*b*) is a sectional view of the container with the contents thereof removed completely;

FIG. 8(*b*) is a sectional view of the container with the contents thereof removed completely;

FIG. 9(*b*) is a partially enlarged sectional view of the container;

FIG. 10(*b*) is a partially enlarged sectional view of the container;

DETAILED DESCRIPTION OF THE EMBODIMENTS

Figure 1A:
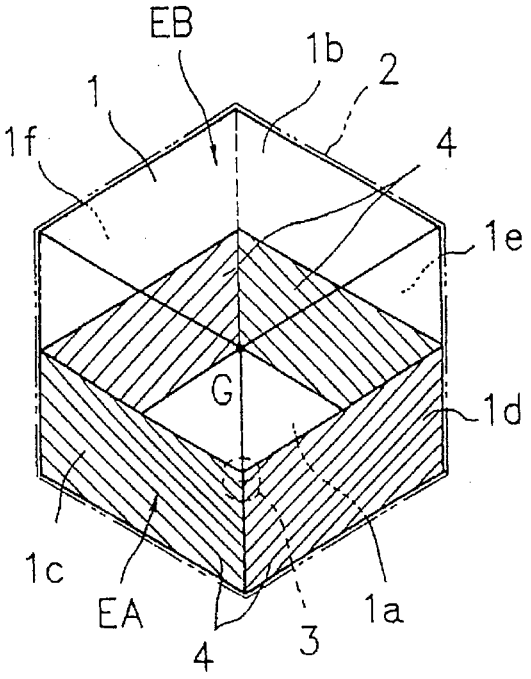
FIG. 1(*a*) is a perspective view of a container for a liquid according to a first embodiment of the present invention.
Figure 1B:
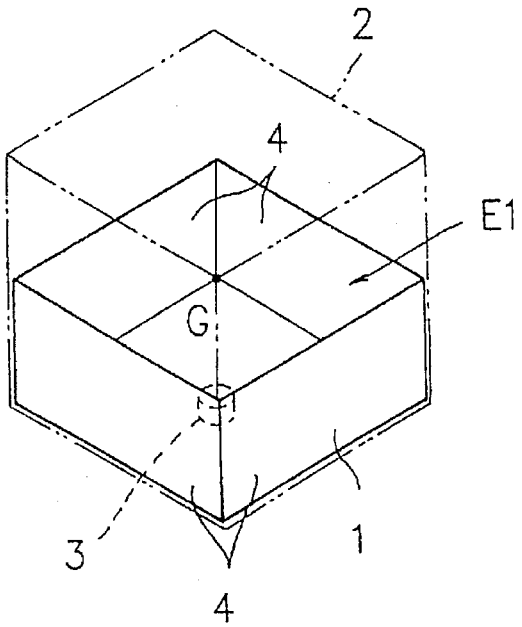
Figure 1C:
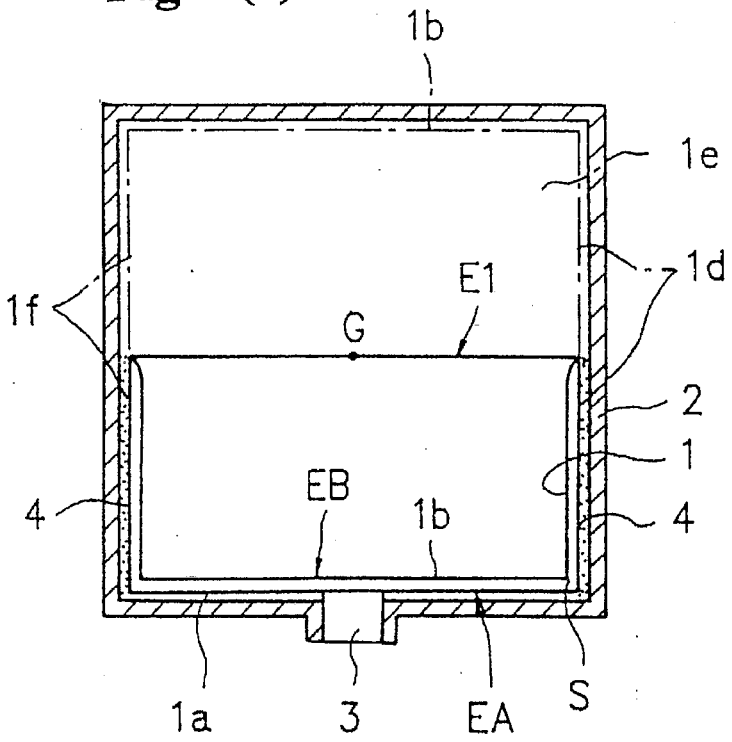

FIG. 1(*a*) is a perspective view of a container for a liquid according to a first embodiment of the present invention; FIG. 1(*b*) is a perspective view of the container with the contents thereof removed completely; and FIG. 1(*c*) is a sectional view of the container, showing states before and after removal of the contents.

The container for a liquid of this embodiment is a BIB container comprising an inner container 1 and an outer container 2. The inner container 1, which is in the shape of a square cube, is formed by a material having flexibility such as a vinyl resin for example. In the inner container 1 is contained any of low to high viscosity liquids, including ink as a high-viscosity liquid, according to an intended use. A discharge port 3 for discharging the contents of the container to the exterior is formed in one face la out of six faces of the inner container 1.

Surfaces of the inner container, more specifically, four surrounding faces 1*c*, 1*d*, 1*e* and 1*f* which are in contact with the face 1*a* with the discharge port 3 formed therein, are partially bonded to the outer container 2. As indicated with hatches in FIG. 1(*a*), faces 4 of the bonded portions extend from the face 1*a* side with the discharge port 3 formed therein up to half of the height of the faces 1*c*, 1*d*, 1*e* and 1*f*.

Consequently, an undeformed portion EA on the face 1*a* side where the discharge port 3 is present and a deformable portion EB on a face 1*b* side opposed to the face 1*a* have similar figures on both sides of a plane E1 which includes a center of gravity G parallel to the face 1*a*. In a completely removed state of the contents of the inner container 1 from the discharge port 3, the deformable portion EB gets into the undeformed portion EA along the inside of the portion EA, as shown in FIGS. 1(*b*) and 1(*c*).

The outer container 3 is formed by a rigid material such as a hard cardboard or the like so as to cover the whole of the inner container 1 exclusive of the discharge port 3. Bonding of the inner container 1 to the outer container 2 is made by an easily separable material so as to permit sorting at the time of discard.

In the container for a liquid constructed as above, when a suction nozzle (not shown) is attached to the discharge port 3 and an external force is applied to the container by the suction force of a pump or the like, there occurs deformation toward the undeformed portion EA and the deformable portion EB slackens and is deformed irregularly to an extent corresponding to a decrease in volume of the contents of the container. This slack becomes maximum when half of the contents has been removed. With further removal of the contents, the deformable portion EB gets into the undeformed portion EA along the inside of the undeformed portion. With subsequent further removal of the contents, the aforesaid slack of the deformable portion EB diminishes gradually and until when the contents are removed nearly completely, portions of the inner container 1 are prevented from adhering closely to each other, thus making it possible to ensure a flowing path of the contents sufficiently without blocking of the discharge port 3. Accordingly, the contents can be withdrawn uniformly and with little residue from beginning to end.

If the height of the bonded faces 4 is set larger even slightly than half of the height of the faces 1*c*, 1*d*, 1*e* and 1*f*, a gap S is formed between the deformable portion EB and the undeformed portion EA, thereby permitting a flowing path of the contents to be ensured sufficiently near the discharge port 3 and permitting removal of the contents without residue. The size of the gap S can be adjusted according to the bonded faces 4. As to the face 1*a* with the discharge port 3 formed therein, since it is held by the outer container 2 which is in close contact with the inner container 1, no special bonding is needed, but bonding thereof will bring about a more outstanding effect.

Figure 2A:
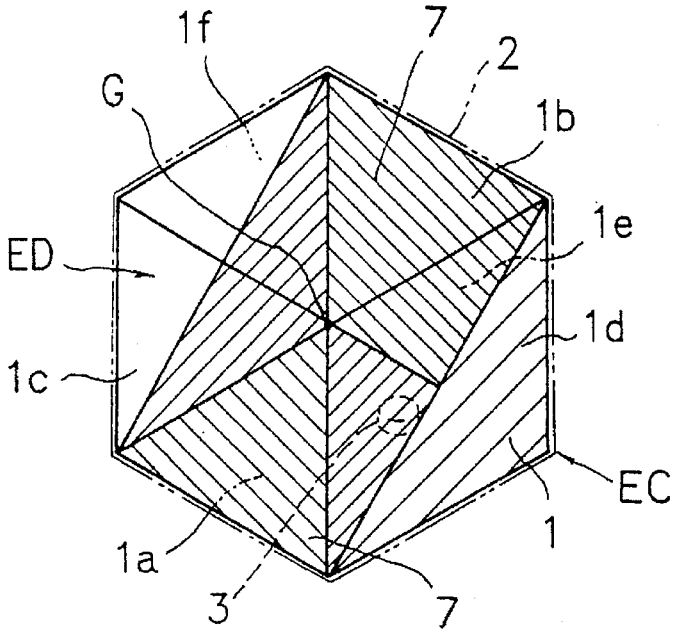
FIG. 2(*a*) is a perspective view of a container for a liquid according to a second embodiment of the present invention.
Figure 2B:
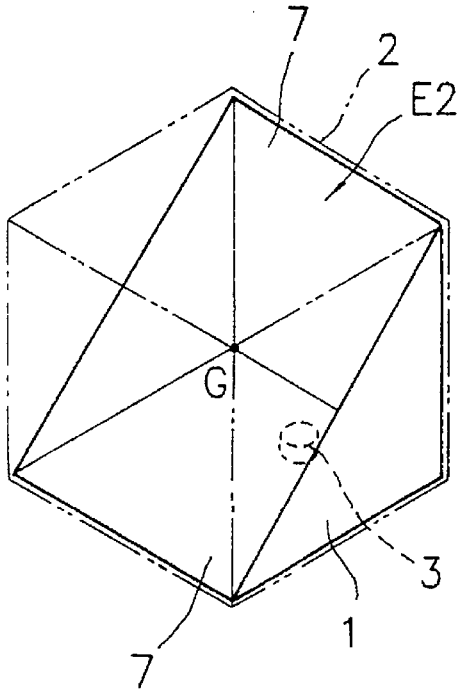
Figure 2C:
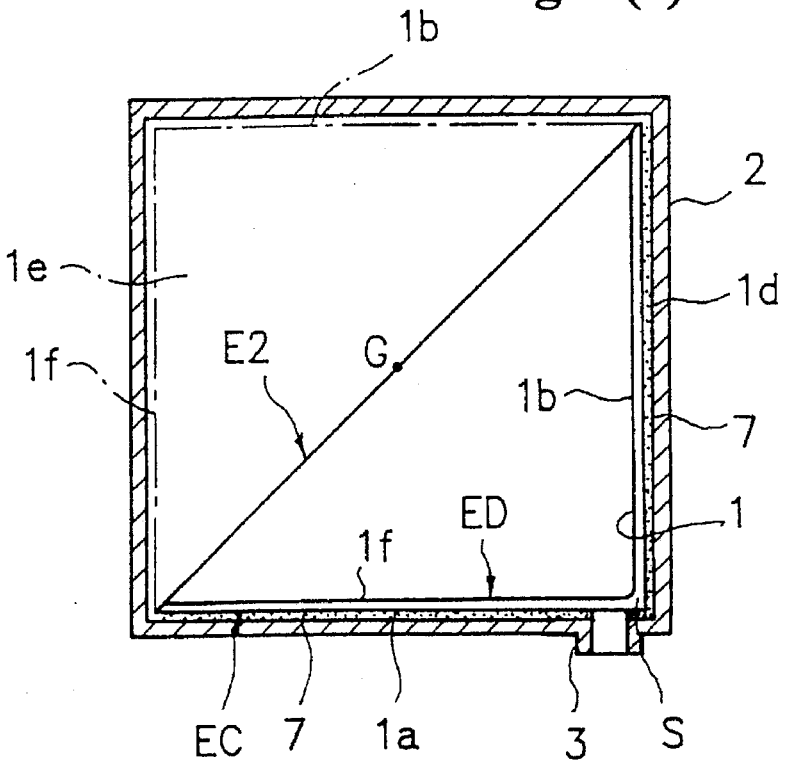

FIG. 2(*a*) is a perspective view of a container for a liquid according to a second embodiment of the present invention, FIG. 2(*b*) is a perspective view of the container with the contents thereof removed completely, and FIG. 2(*c*) is a sectional view of the container, showing states before and after removal of the contents.

The container of this embodiment is a modification of the container shown in FIG. 1(*a*)–1(*c*), with a difference residing in the bonded portion. As indicated with hatches in FIG. 2(*a*), bonded faces 7 comprise a face 1*a* with a discharge port 3 formed therein, a face 1*e* which is in contact with the face 1*a*, and triangular portions, on the side of discharge port 3, of faces 1*d* and 1*f* which are in contact with the faces 1*a* and 1*e*. Consequently, an undeformed portion EC on the face 1*a* side with the discharge port 3 formed therein and a deformable portion ED on the side of a face 1*b* opposed to the face 1*a* have similar figures on both sides of a diagonal plane E2 including a center of gravity G which is at an angle of 45 degrees relative to the face 1*a*.

In the container of this embodiment, as the contents of the container are removed, the deformable portion ED on the unbonded face side is deformed toward the undeformed portion EC on the side of the bonded face 7. The deformable portion ED slackens and is deformed irregularly to an extent corresponding to the decrease in volume of the container contents, but after half of the contents has been removed, the deformable portion ED gets into the undeformed portion EC along the inside of the undeformed portion EC gradually deeply with removal of the contents, so that the aforesaid slack of the deformable portion ED diminished gradually. Thus, until complete removal of the contents, portions of the inner container 1 are prevented from adhering closely to each other and it is possible to ensure a flowing path of the contents sufficiently without blocking of the discharge port 3, thus making it possible to withdraw the contents uniformly and with little residue from beginning to end.

Figure 3A:
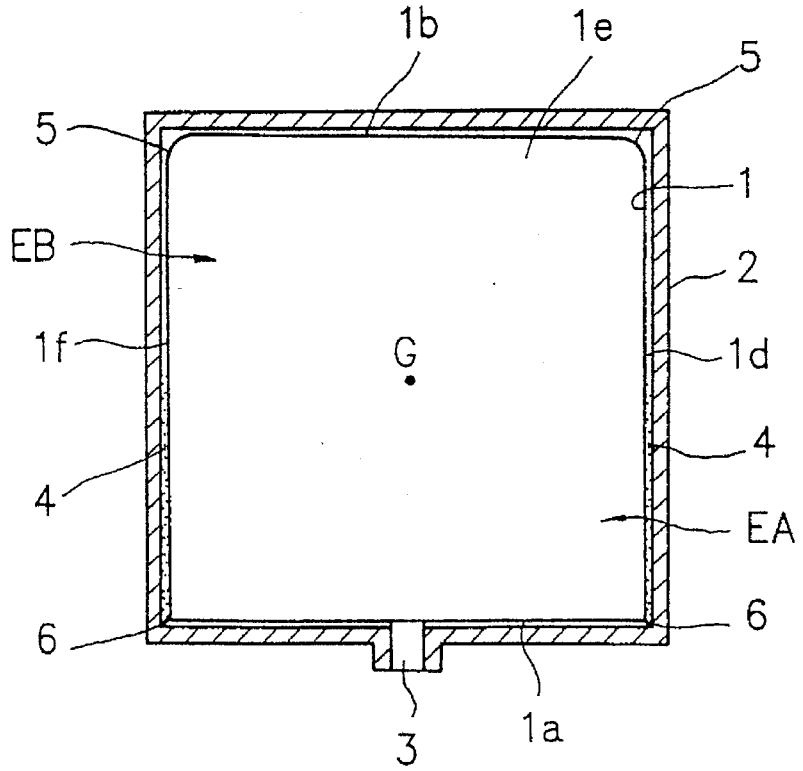
FIG. 3(*a*) is a view showing a container for a liquid according to a third embodiment of the present invention.
Figure 3B:
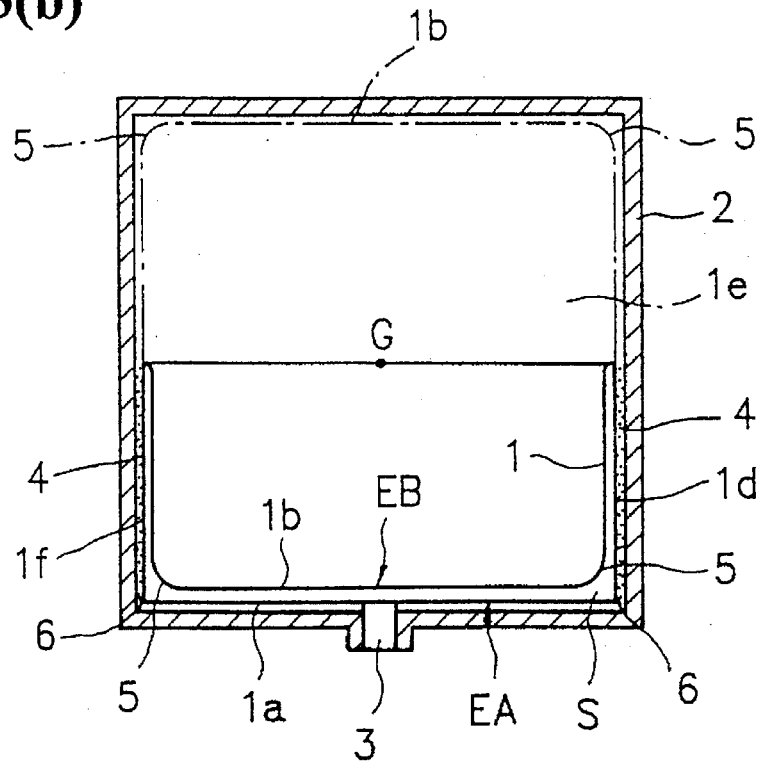

FIG. 3(*a*) is a view showing a container for a liquid according to a third embodiment of the present invention, and FIG. 3(*b*) is a sectional view of the container, showing states before and after removal of the contents.

In the liquid container of this embodiment, as compared with the liquid container of the construction shown in FIGS. 1(*a*)–1(*c*), the radius of curvature (hereinafter referred to as "R") of an edge portion 5 defined by the faces of unbonded portion of inner container 1 is made larger than that of an edge portion 6 defined by the faces of bonded portions.

In this embodiment, when the inner container 1 is deformed by flowing of the contents thereof in the course of removal of the contents from the discharge port 3, a deformable portion EB gets into an undeformed portion EA on a bonded face 4 side because bonded faces 4 are incapable of being deformed. But since the corner portion 5 defined by unbonded faces is larger in R than the corner portion 6 defined by bonded faces 4, a gap S is formed between both corner portions, whereby close adherence between portions of the inner container 1 is prevented and it is possible to ensure a sufficient flowing path of the contents up to the discharge port 3.

Figure 4A:
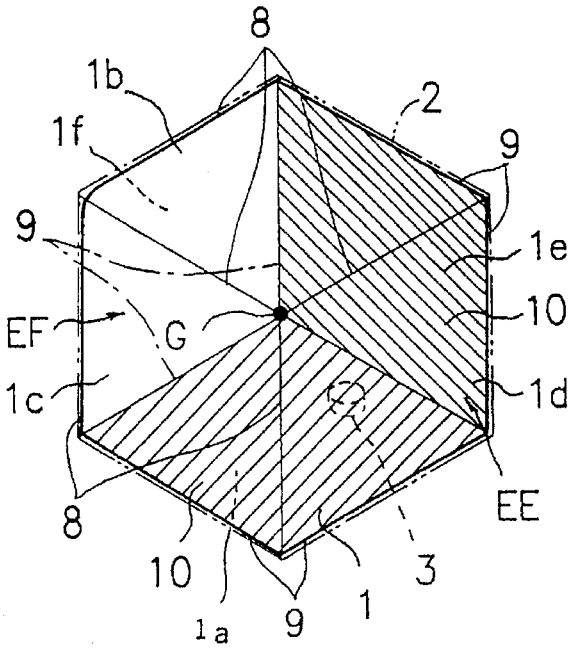
FIG. 4(*a*) is a perspective view of a container for a liquid according to a fourth embodiment of the present invention.
Figure 4B:
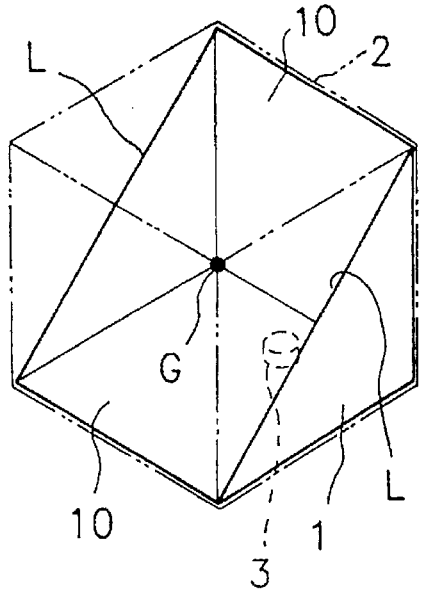
Figure 4C:
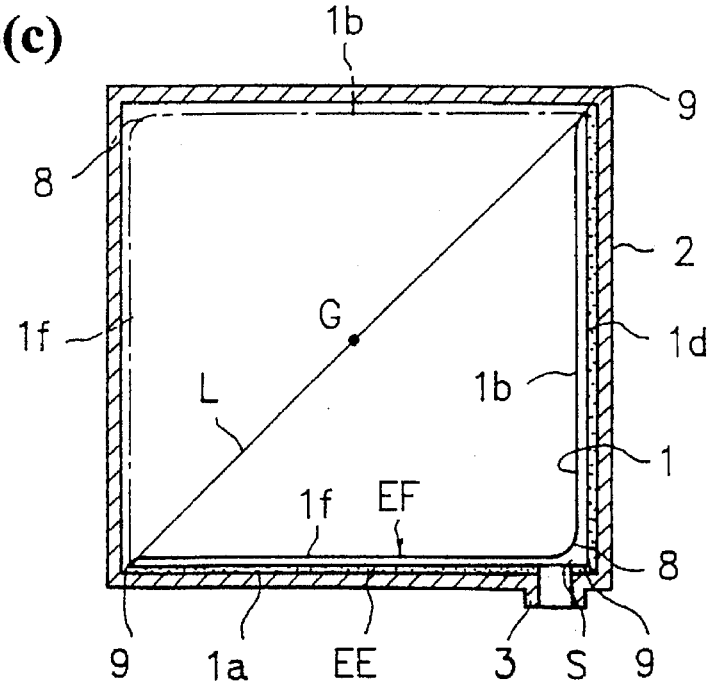

FIG. 4(*a*) is a perspective view of a container for a liquid according to a fourth embodiment of the present invention, FIG. 4(*b*) is a perspective view of the container with the contents thereof removed completely, and FIG. 4(*c*) is a sectional view of the container, showing states before and after removal of the contents.

In the liquid container of this embodiment, which is a modification of the liquid container shown in FIGS. 2(*a*)–2(*c*), a face 1*a* of an inner container 1 with a discharge port 3 formed therein and any one of faces (1*c*, 1*d*, 1*e*, 1*f*) which are in contact with the face 1*a*, namely two faces, are bonded to an outer container 2. An edge portion 8 defined by unbonded faces of the inner container 1 is larger in R than an edge portion 9 defined by the bonded faces 10.

In this embodiment, as the contents of the container are withdrawn from the discharge port 3 while diagonal portions L of both-side faces 1*d* and 1*f* which are in contact with both bonded faces 10 are held by the outer container 2, a deformable portion EF on the face 1*b* side opposed to the face 1*a* with the discharge port 3 formed therein gets into an undeformed portion EE on the discharge port 3 side. Consequently, even without special bonding of both-side faces 1*d* and 1*f* which are in contact with both bonded faces 10 as indicated with hatches in the drawing, the diagonal portions L of the faces 1*d* and 1*f* can be held by the outer container 2, whereby it is made possible to minimize the number of faces and bonding area of the inner container 1 with respect to the outer container 2.

When the deformable portion EF gets into the undeformed portion EE on the bonded face 10 side in the course of removal of the contents, a gap S is formed between the edge portion 8 on the unbonded face side and the edge portion 9 on the bonded face 10 side, so that, as in the liquid container shown in FIGS. 2(*a*)–2(*c*), close adherence between portions of the inner container i is prevented and it is possible to ensure a flowing path of the contents sufficiently up to the discharge port 3.

Although in each of the above embodiments the inner container is in the shape of a square cube, the same effect as above will be obtained also in the shape of a rectangular parallelepiped, including a rectangular cube.

In each of the above embodiment, moreover, it is not necessary that the bonded faces 4, 7 and 10 be bonded over the whole faces thereof to the outer container if only they are not deformed. Those faces may be bonded to the outer container at plural points including corners thereof or in the form of a belt.

According to the liquid container defined in first and second aspects of the present invention, the whole of the soft inner container is divided into two portions which are deformation portion and undeformed portion, and as the contents of the container are withdrawn from the discharge port, only the deformable portion gets into the undeformed portion gradually deeply along the inside of the undeformed portion. At this time, the deformation of the deformable portion is restricted by the undeformed portion to prevent close adherence between portions of the inner container, thereby permitting a sufficient flowing path of the container contents to be ensured. Therefore, the load on the suction pump can be reduced and it is possible to withdraw the contents uniformly from beginning to end. Besides, because of no unexpected residue, it is possible to withdraw a predetermined amount of the contents completely and surely.

Further, since a corner where a unbonded portion is present or a corner where unbonded faces are in contact with each other is in a shape having R, in the inner container, a sufficient gap is formed between the deformable portion and the undeformed portion of the inner container, whereby close adherence between portions of the inner container can be prevented surely and it is possible to ensure a sufficient flowing path of the container contents up to the discharge port.

Figure 5B:
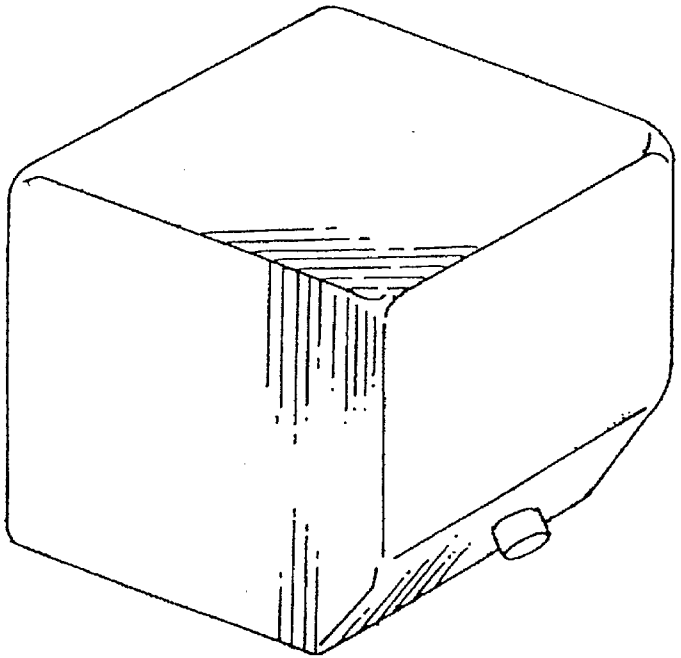
FIG. 5(*a*) is a front view and FIG. 5(*b*) is a perspective view, illustrating another shape of a cubic container to which the present invention can be applied.
Figure 5A:
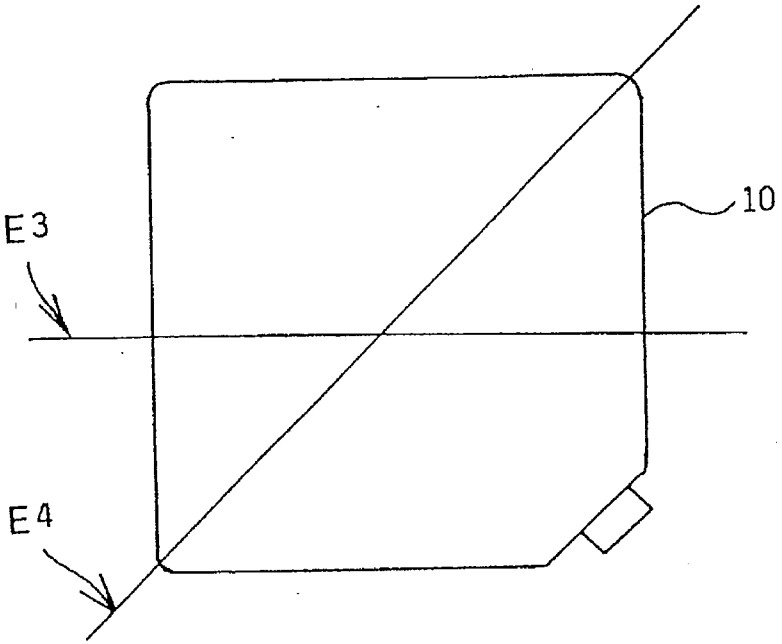

Although in each of the above embodiments the container is in the form of a cube, there may be adopted other shapes, including rectangular parallelepiped, prism, cylinder, sphere, as well as a cubic container 10 in FIGS. 5(*a*)–5(*b*) capable of being divided into two portions in axial symmetry by an imaginary plane indicated at E3 or E4.

Figure 6A:
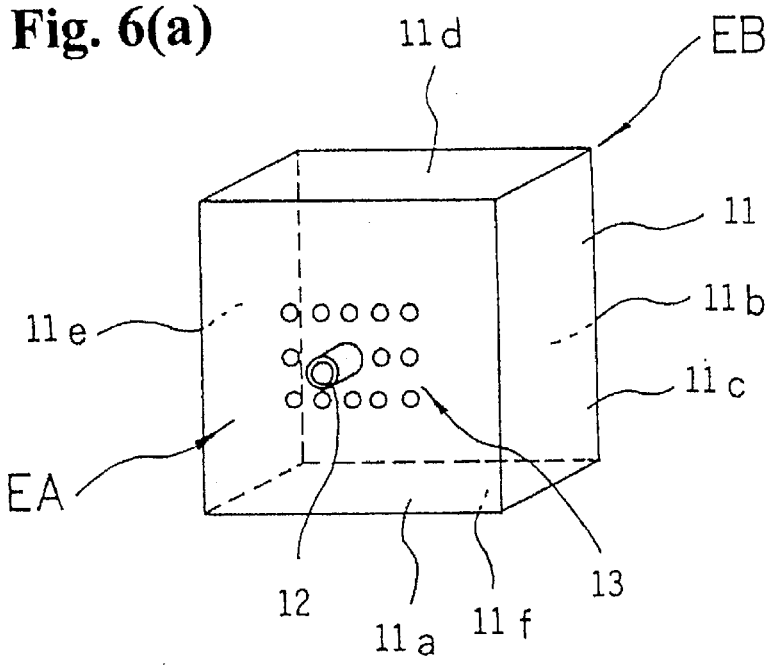
FIG. 6(*a*) is a perspective view of a container for a liquid according to a fifth embodiment of the present invention.
Figure 6B:
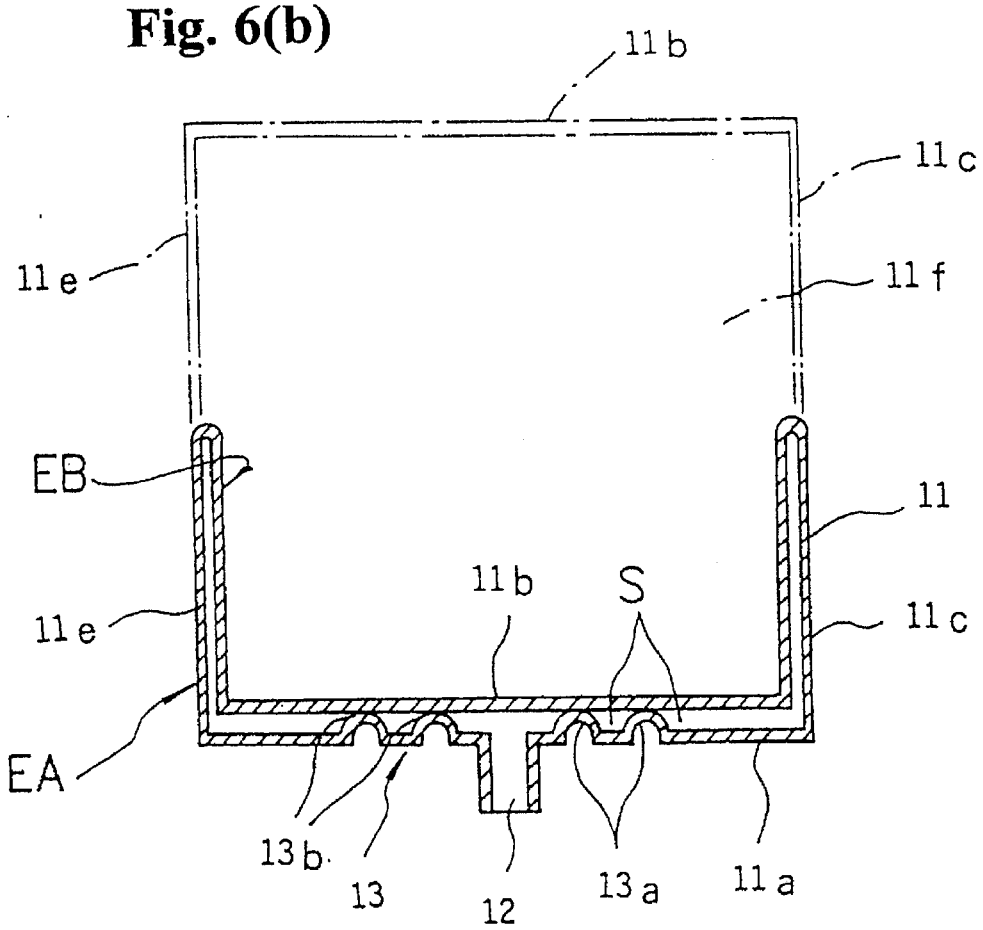

FIG. 6(*a*) is a perspective view of a container for a liquid acceding to a fifth embodiment of the present invention, and FIG. 6(*b*) is a sectional view of the container with the contents thereof removed completely.

The liquid container of this embodiment is a single container corresponding to the inner container of a BIB container for any of low to high viscosity liquids, including printing ink as a high-viscosity liquid, according to an intended use. The whole of the container, indicated at 11, is formed in the shape of a square cube using a material having flexibility such as vinyl resin or the like. In the container 11, a face 11*a* wherein is formed a discharge port 2 for discharge of the container contents and approximately one-half portions from the face 11*a* of faces 11*c*, 11*d*, 11*d* and 11*f* which are in contact with the face 11*a*, are used as an undeformed portion EA, while the other portion except the undeformed portion EA is used as a deformable portion EB, and the wall thickness of the deformable portion EB is made smaller than that of the undeformed portion EA, whereby the deformable portion EB is made less rigid than the undeformed portion EA relatively so that as the contents are withdrawn, the deformable portion bends and gets into the undeformed portion EA along the inside of the undeformed portion. Around a discharge port 12 formed in the face 11*a* there are provided a plurality of semispherical inward protuberances 13 comprising concaves 13*a* and convexes 13*b*.

In the liquid container constructed as above, when a suction nozzle (not shown) is attached to the discharge port 12 and an external force is applied to the container 11 by the suction force of a pump or the like, the deformable portion EB is deformed while getting in toward the inner wall surfaces of the undeformed portion EA and the contents of the container 11 are withdrawn from the discharge port 12.

With removal of the contents, the inner wall surfaces of the deformable portion EB approach the inner wall surfaces of the undeformed portion EA, resulting in that gaps S which are in communication with the discharge port 12 are formed like meshes around the discharge port by means of the protuberances 13. Consequently, close adherence of the inner wall surfaces at the portion of the discharge port 12 is prevented and it is possible to ensure a sufficient flowing path of the contents around the discharge port, thus permitting the contents to be withdrawn uniformly and with little residue from beginning to end. When the contents are discharged through the discharge port 12, the resistance to the flow of the contents is small because the shape of the protuberances 13 are in a semispherical shape, so that the contents can be conducted smoothly to the discharge port 12.

Figure 7A:
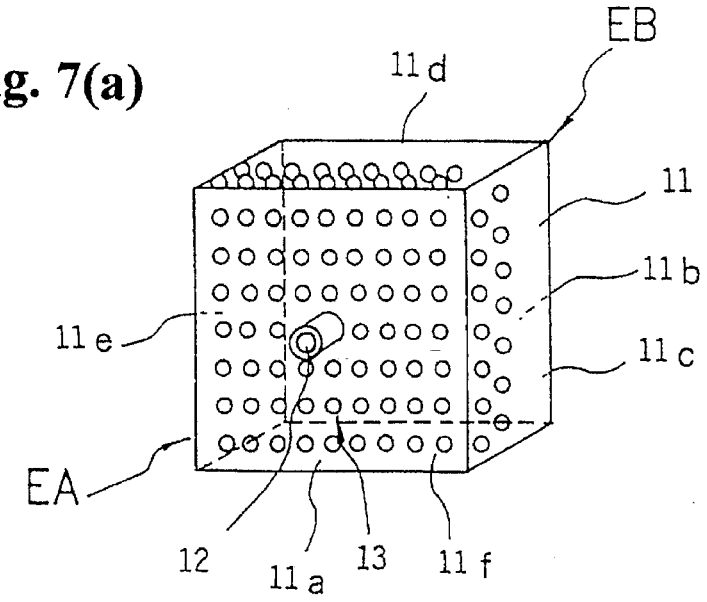
FIG. 7(*a*) is a perspective view of a container for a liquid according to a sixth embodiment of the present invention.
Figure 7B:
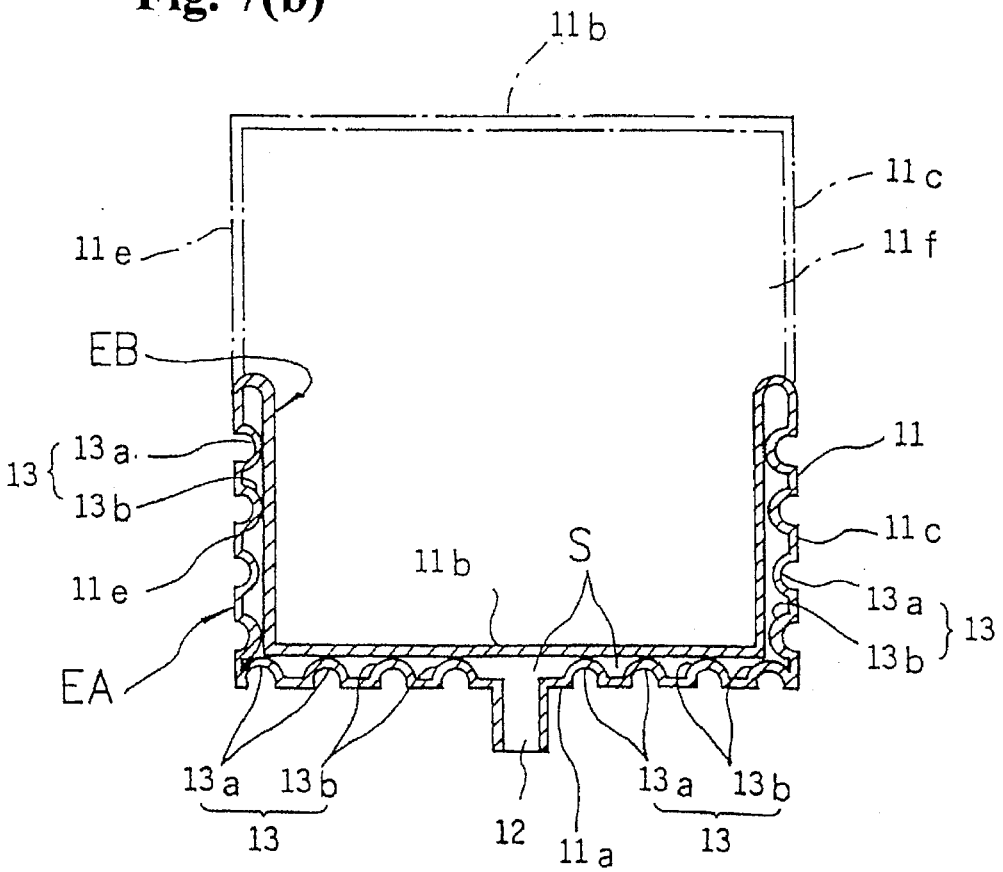

FIG. 7(*a*) is a perspective view of a container for a liquid according to a sixth embodiment of the present invention, and FIG. 7(*b*) is a sectional view of the container with the contents thereof removed completely, in which the portions common to FIGS. 6(*a*) and 6(*b*) are indicated by the same reference numerals as in FIGS. 6(*a*) and 6(*b*).

In the liquid container of this embodiment, the whole of the container, indicated at 11, is formed in the shape of a square cube using a material having flexibility such as vinyl resin or the like. In the container 11, a face 11*a* with a discharge port 12 formed therein and approximately one-half portions from the face 11*a* of faces 11*c* lid, lie and 11*f* which are in contact with the face 11*a*, are used as an undeformed portion EA, while the other portion except the portion EA is used as a deformable portion EB, and the wall thickness of the deformable portion EB is made smaller than that of the undeformed portion EA, whereby the rigidity of the deformable portion EB is made relatively weaker than that of the undeformed portion EA, so that with removal of the contents, the deformable portion EB bends and gets into the undeformed portion EA along the inside of the undeformed portion.

Further, a plurality of semispherical inward protuberances 13 comprising concaves 13*a* and convexes 13*b* are formed throughout the undeformed portion EA.

In this embodiment, as is the case with the liquid container shown in FIGS. 6(*a*) and 6(*b*), when a suction nozzle (not shown) is attached to the discharge port 12 and an external force is exerted on the container 1 by the suction force of a pump or the like, the deformable portion EB is deformed while getting in toward the inner wall surfaces of the undeformed portion EA, and the contents of the container 11 are discharged from the discharge port 12.

When the inner wall surfaces of the deformable portion EB approach the inner wall surfaces of the undeformed portion EA with removal of the contents, gaps S which are in communication with the discharge port 12 are formed like meshes within the container 11 by means of the protuberances 13. Consequently, close adherence between the inner wall surfaces of the container 11 is prevented and it is possible to ensure a flowing path of the contents sufficiently.

Figure 8A:
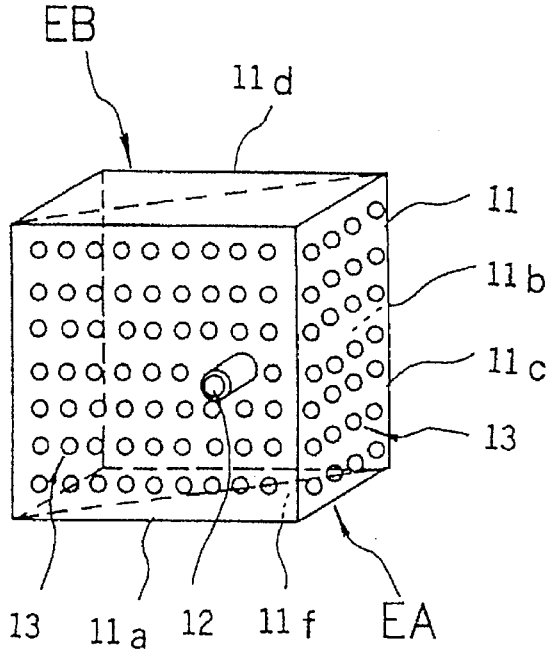
FIG. 8(*a*) is a perspective view of a container for a liquid according to a seventh embodiment of the present invention.
Figure 8B:
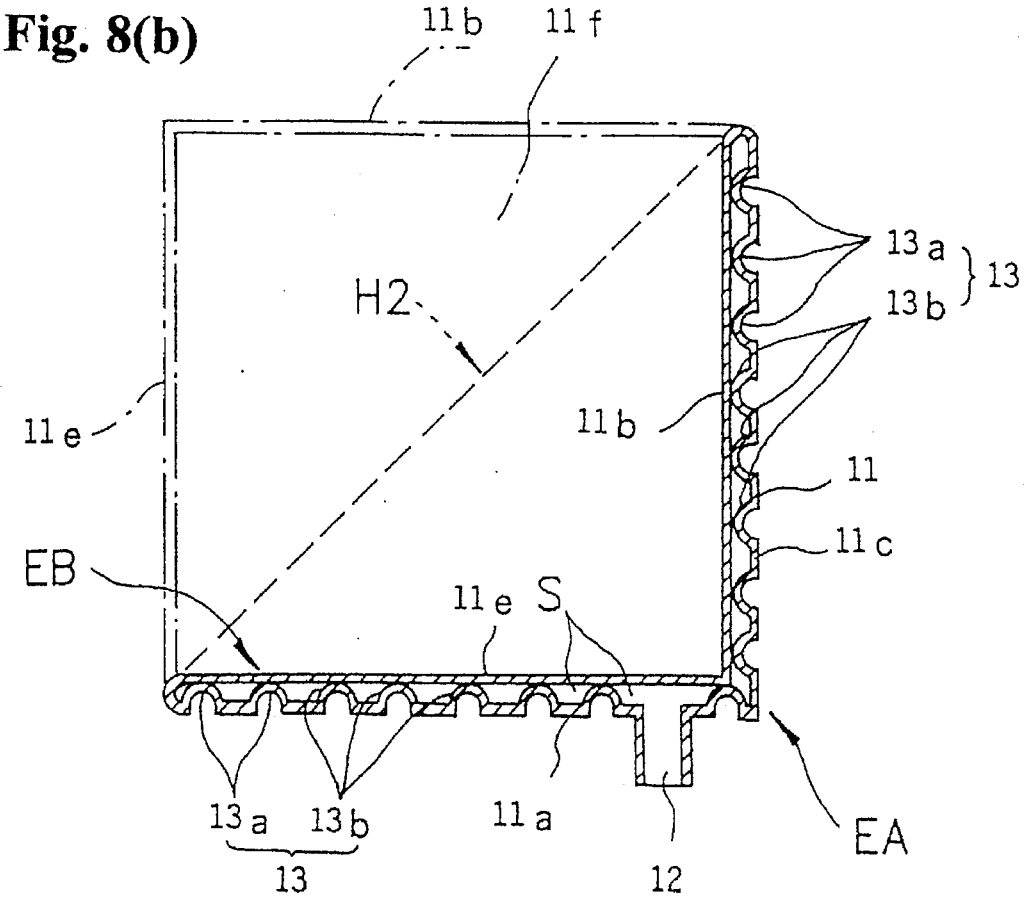

FIG. 8(*a*) is a perspective view of a container for a liquid according to a seventh embodiment of the present invention, and FIG. 8(*b*) is a sectional view of the container with the contents thereof removed completely, in which the portions common to FIGS. 6(*a*) and 6(*b*) are indicated by the same reference numerals as in FIGS. 6(*a*) and 6(*b*).

According to this embodiment, in a container 11 which is in the shape of a square cube, protuberances 13 are formed on a face 11*a* with a discharge port 12 formed therein and also on another face 11*c* which is in contact with the face 11*a*. The wall thickness of other faces 11*b*, 11*d*, 11*e* and 11*f* is made smaller than that of the faces 11*a*, 11*c*, whereby the rigidity of a deformable portion EB on the face 11*b* side is made relatively weaker than that of an undeformed portion EA on the face 11*a* side with the base H2 of a triangle as a boundary which triangle include the faces 11*a* and 11*c* as equilateral.

In this embodiment, when a suction nozzle (not shown) is attached to the discharge port 12 and an external force is exerted on the container 11 by the suction force of a pump or the like, the deformable portion EB not including the protuberances 13 is deformed while the inner wall of the face 11*b* opposed to the face 11*a* with the discharge port 12 formed therein gets in toward the inner wall of the face 11*a* with the base H2 as a boundary, whereby the contents of the container 11 can be discharged from the discharge port 12.

Even when the inner wall of the face 11*e* approaches the inner wall of the face 11*a* with the discharge port 12 formed therein as the contents of the container are discharged, gaps S are formed by the protuberances 13, so that close adherence between the inner wall surfaces of the container 11 is prevented and it is possible to ensure a flowing path of the container sufficiently.

Figure 9A:
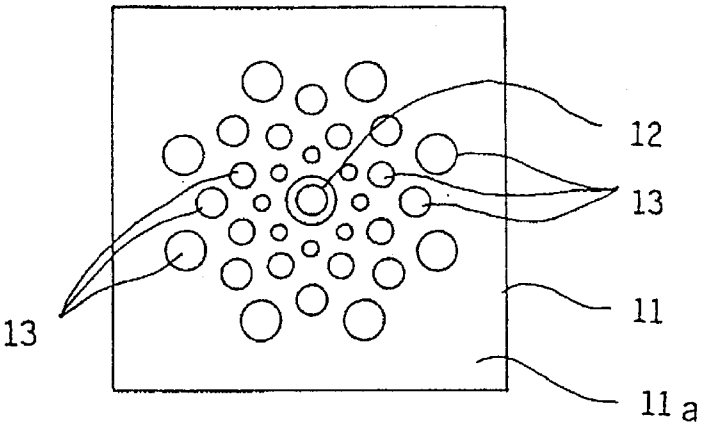
FIG. 9(*c*) is a view showing a container for a liquid according to an eighth embodiment of the present invention.
Figure 9B:
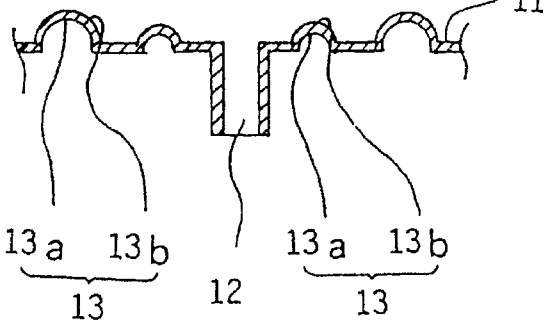
Figure 11:
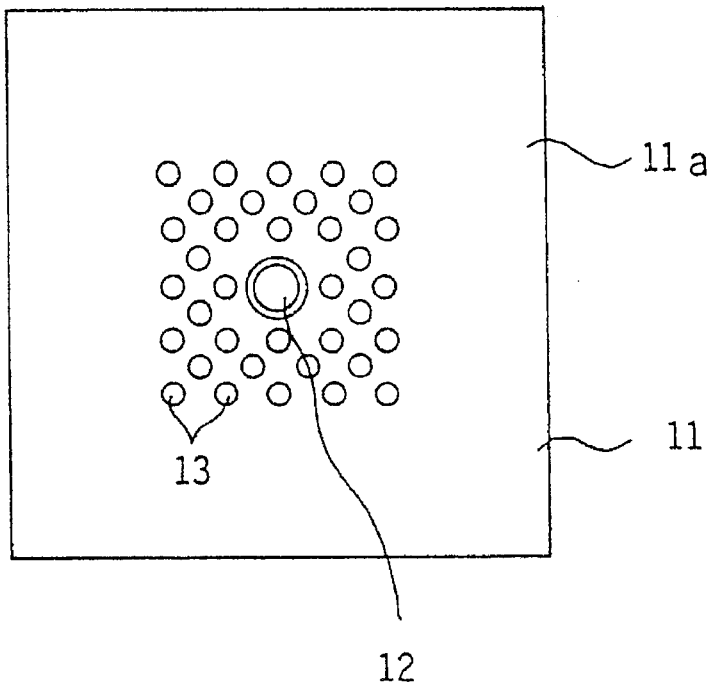
FIG. 11 is a view showing another arrangement example of protuberances in a container for a liquid according to the present invention.

FIG. 9(*a*) is a view showing a container for a liquid according to an eighth embodiment of the present invention, and FIG. 9(*b*) is a partially enlarged sectional view of the container, in which the portions common to FIGS. 6(*a*) and 6(*b*) are indicated by the same reference numerals as in FIGS. 6(*a*) and 6(*b*).

According to this embodiment, protuberances 13 are formed in the container, indicated at 11, radially around a discharge port 12 in such a manner that the projecting degree of the protuberances 13 and the spacing thereof (center-to-center distance) become smaller as the distance from the discharge port 12 becomes shorter. While the contents of the container are discharged from the discharge port 12 and as the inner wall of a face opposed to a face 11*a* with the discharge port formed therein approaches the inner wall of the face 11*a*, the amount of the container contents to be discharged is restricted to some extent in the vicinity of the discharge port 12 to keep the diminishing degree of the container contents uniform. This construction is effective for a soft ink which is easy to pass through the discharge port.

Figure 10A:
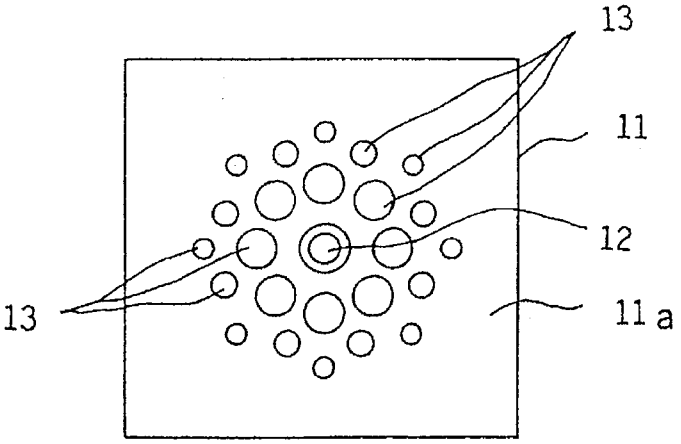
FIG. 10(*a*) is a view showing a container for a liquid according to a ninth embodiment of the present invention.
Figure 10B:
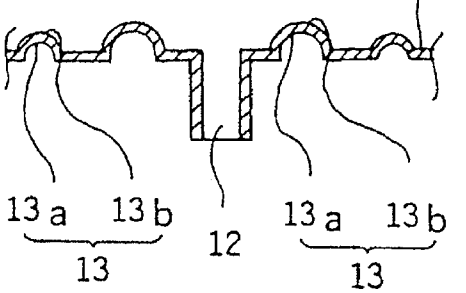

FIG. 10(*a*) is a view showing a container for a liquid according to a ninth embodiment of the present invention, and FIG. 10(*b*) is a partially enlarged sectional view of the container, in which the portions common to FIGS. 6(*a*)–6(*b*) are indicated by the same reference numerals as in FIGS. 6(*a*) and 6(*b*).

According to this embodiment, protuberances 13 are formed in the container, indicated at 11, radially around a discharge port 12 in such a manner that their projecting degree and spacing are larger as the distance from the discharge port 12 becomes shorter. While the container contents are discharged from the discharge port 12 and as the inner wall surface of a face 11*b* opposed a face 11*a* with the discharge port 12 formed therein approaches the inner wall of the face 11, it is possible to withdraw a larger amount of the container contents from the discharge port 12 while ensuring a sufficient amount of the contents around the discharge port. This construction is effective for a hard ink which is difficult to pass through the discharge port 12.

Although in each of the above embodiments the rigidity of the undeformed portion EA is made relatively stronger than that of the deformable portion EB, there may be adopted another suitable method for creating such a difference in rigidity, for example a method of selecting suitable materials and a method of laminating another member to the portion to have enhanced rigidity (if protuberances 13 are arranged in an alternate fashion, the rigidity will be further enhanced), As a positional modification of the protuberances 13 from those illustrated in the above embodiments, the protuberances may be provided on the face opposed to the protuberance-bearing face in the illustrated embodiments when the deformable portion EB is deformed along the undeformed portion Ea.

Moreover, if the protuberances 13 are formed regularly so as to form a linear gap S toward the discharge port 12, the resistance to the flow of the container contents will be reduced, resulting in that the flow becomes smoother and the load on the pump can be diminished.

Although the container according to each of the above embodiments is constituted by only the inner container in the conventional BIB container, it goes without saying that an outer container may be provided so as to cover the container except the discharge port as in the BIB container. In this case, by fixing the undeformed portion EA to the outer container, the rigidity of the undeformed portion EA can be made relatively stronger than that of the deformable portion EB, so the whole of the container can be constituted uniformly using the same material or member without the need of providing a difference in wall thickness between the undeformed portion EA and the deformable portion EB or the need of using different materials.

Further, although in each of the above embodiments the container is in the form of a cube, there may be adopted other shapes, including rectangular parallelepiped, prism, cylinder, sphere, as well as a cubic container capable of being divided into two portions in axial symmetry by an imaginary plane indicated at E3 or E4.

Figure 12A:
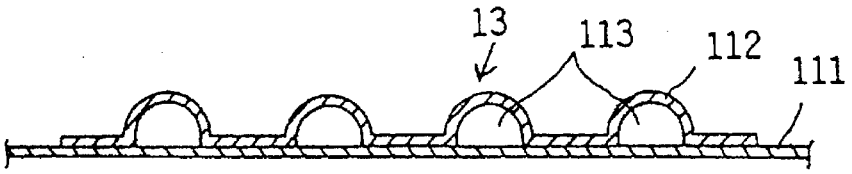
FIG. 12 is a view showing further examples of protuberances in a container for a liquid according to the present invention.
Figure 12B:
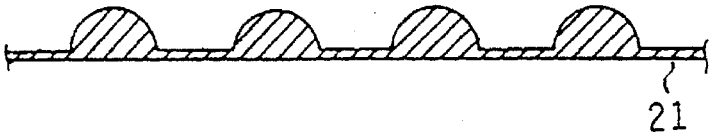
Figure 13:
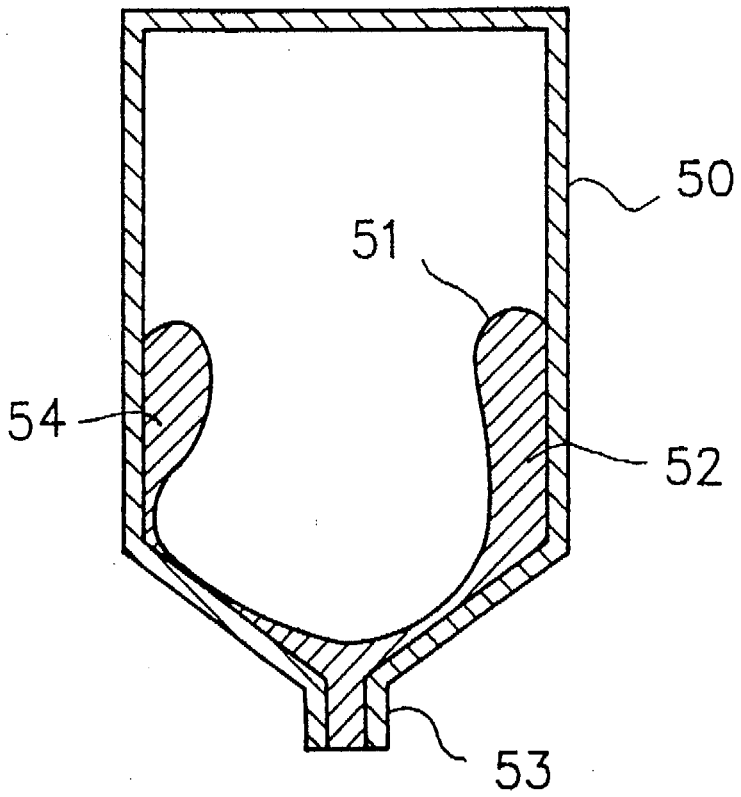
Fig. 13 Prior Art
FIG. 13 is a view showing an example of a conventional container for a liquid.

Although the protuberances 13 described above are semispherical for minimizing the resistance to the flow of the contents, the shape of the protuberances may be a polygonal shape such as, for example, triangle or square depending on the viscosity of the container contents, whereby the resistance to the flow of the contents can be varied according to the contents' viscosity. As shown in FIG. 12(*a*), the protuberances 13 may be semispherical cavities 113 each sealed independently and formed by laminating an auxiliary member 112 to a base member 111 as a constituent of the container 11 by welding for example. Further, as shown in FIG. 12(*b*), the base member 21 as a constituent of the container 11 may be rendered thick in a semispherical shape to form semispherical protuberances 13.

As set forth above, since the liquid container described in the fifth aspect is constituted by a soft, deformable member having protuberances around the contents discharge port, it is possible to prevent close adherence of inner wall surfaces in the vicinity of the discharge port and hence possible to ensure a sufficient flowing path of the container contents around the discharge port, thus permitting the contents to be discharged in uniform volume and with little residue from beginning to end.

As to the liquid container described in the sixth aspect, since it is constituted by a soft, deformable member having protuberances on approximately one-half of the face wherein the discharge port is formed, close adherence of inner wall surfaces at the discharge port portion can be prevented and it is possible to ensure a sufficient flowing path of the container contents not only around the discharge port but also up to the same port, thus permitting the contents to be discharged in uniform volume and with little residue from beginning to end.

According to the liquid container described in the seventh aspect, since the projecting degree or spacing of protuberances is made smaller as the distance from the discharge port becomes shorter, the amount of the contents to be discharged in the vicinity of the discharge port is limited to some extent, whereby it is made possible to keep the diminishing degree of the container contents uniform. This arrangement is effective for a soft ink which is easy to pass through the discharge port.

Further, according to the liquid container described in the eighth aspect, since the projecting degree or spacing of protuberances is made larger as the distance from the discharge port becomes shorter, it is possible to ensure a sufficient amount of the container contents around the discharge port and hence possible to withdraw a larger amount of the contents from the discharge port. This arrangement is effective for a hard ink which is difficult to pass through the discharge port.

What is claimed is:

1. A container for a fluid comprising:

an outer container having rigidity, an inner container for containing the fluid therein disposed in the outer container, said inner container having flexibility and faces contacting the outer container, said inner and outer containers having a common discharge port at a bottom area of the container and being connected together at least at connecting portions so that a half of the faces of the inner container including a basic face where the common discharge port is located does not substantially separate from the outer container, and a gravity center, parts of the faces of the inner container located under a plane passing through the gravity center being fixed to the outer container, and at least a part of said basic face and at least a part of a face situated adjacent to said basic face being fixed so that the faces of the inner container located above the connecting portions do not substantially close the common discharge port until the fluid in the inner container becomes substantially empty when the fluid is ejected through the common discharge port.

2. A container for a fluid according to claim 1, wherein said inner and outer containers have generally square shapes, and said basic face is fixed to the outer container so that portions of the faces including the basic face are fixed to the outer container.

3. A container for a fluid according to claim 2, wherein the faces, located at a side of the container having the common discharge port relative to a diagonal plane extending diagonally between a side edge of said basic face and a side edge of a face located opposite to said basic face, are fixed to the outer container.

4. A container for a fluid according to claim 3, wherein said basic face and at least one face situated adjacent to said basic face are fixed to the outer container.

5. A container for a fluid according to claim 4, wherein said inner container has deformable and undeformable portions which have substantially the same shapes.

6. A container for a fluid according to claim 1, wherein said inner container has unfixed edge portions not fixed to the outer container and fixed edge portions fixed to the outer container, each of said unfixed edge portions having a curvature larger than that in said fixed edge portions.

7. A container for a fluid according to claim 1, wherein said container consists essentially of said inner and outer containers.

* * * * *